United States Patent [19]

Nagura

[11] 4,252,045

[45] Feb. 24, 1981

[54] MOUTH-PIECE FOR ELECTRONIC MUSICAL INSTRUMENTS

[75] Inventor: Yasuo Nagura, Hamamatsu, Japan

[73] Assignee: Nippon Gakki Seizo Kabushiki Kaisha, Japan

[21] Appl. No.: 30,150

[22] Filed: Apr. 16, 1979

[30] Foreign Application Priority Data

Apr. 17, 1978 [JP] Japan ..... 53/49396[U]

[51] Int. Cl.[3] ..... G10H 3/00

[52] U.S. Cl. ..... 84/1.14; 84/DIG. 21

[58] Field of Search ..... 84/1.04, 1.06, 1.09–1.14, 84/1.24, 1.27, DIG. 20, DIG. 21

[56] References Cited

U.S. PATENT DOCUMENTS

| | | | |
|---|---|---|---|
| 2,868,876 | 1/1959 | Ticchioni | 84/1.04 X |
| 3,250,843 | 5/1966 | Jenny | 84/1.09 |
| 3,429,976 | 2/1969 | Tomcik | 84/1.12 |
| 3,439,106 | 4/1969 | Goodale | 84/1.1 X |
| 3,558,795 | 1/1971 | Barcus et al. | 84/1.14 |
| 3,767,833 | 10/1973 | Noble et al. | 84/1.11 X |
| 3,938,419 | 2/1976 | De Rosa | 84/1.14 |
| 4,085,646 | 4/1978 | Naumann | 84/1.09 |
| 4,119,007 | 10/1978 | Criglar et al. | 84/1.14 |

*Primary Examiner*—S. J. Witkowski

*Attorney, Agent, or Firm*—Ostrolenk, Faber, Gerb & Soffen

[57] ABSTRACT

A mouth-piece for electronic musical instruments includes at least one flexible valve flap exposed in the air passage formed therein each of which carries a pressure responsive element generative of electric signals in accordance with the extend of flexion of the valve flap when blown by the player.

12 Claims, 15 Drawing Figures

MOUTH-PIECE FOR ELECTRONIC MUSICAL INSTRUMENTS

BACKGROUND OF THE INVENTION

The present invention relates to an improved mouth-piece for electronic musical instruments, and more particularly relates to improvement in construction of a mouth-piece used for control of tone volume, tone colour and other elements of musical tones in accordance with blow pressure on electronic musical instruments.

It is well known to control elements of musical tones such as tone volume in accordance with the magnitude of blow pressure at a mouth-piece used for an electronic musical instrument in order to obtain an acoustic effect which is similar to that obtained with natural wind instruments. However, the conventional mechanisms for such control are intricate in construction and difficult to adjust with the result that they are often out of order.

Further, in the case of the conventional control mechanism of the above-described type, a linear relationship exists between the blow pressure at the mouth-piece and the corresponding output from the control mechanism. In contrast to this, the output from the natural wind instrument, tone volume, for example, has a certain saturation point beyond which an increase in magnitude of the blow pressure at the mouth-piece will not increase tone volume. Due to this difference, musical tones generated by conventional electronic wind instruments are, in general, quite unlike those generated by natural wind instruments.

SUMMARY OF THE INVENTION

It is a primary object of the present invention to provide a mouth-piece for an electronic musical instrument which is very simple in construction and adjustment.

It is another object of the present invention to provide a mouth-piece for an electronic musical instrument which can be kept in good order for long periods.

It is another object of the present invention to provide a mouth-piece for electronic musical instruments which enables generation of musical tones in much the same manner as those by natural wind instruments.

In accordance with the basic concept of the present invention, a flexible valve flap is provided within the air passage formed in the mouth piece and a pressure responsive element is disposed to the valve flap so that the element generates electric signals in response to deflection of the valve flap when the mouth-piece is blown by the player.

DESCRIPTION OF THE PREFERRED EMBODIMENTS

Figure 1A:
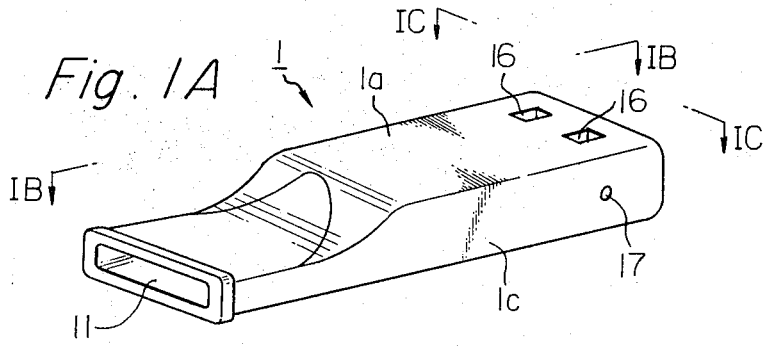
FIG. 1A is a perspective view of one embodiment of the main body of the mouth-piece in accordance with the present invention.
Figure 1B:
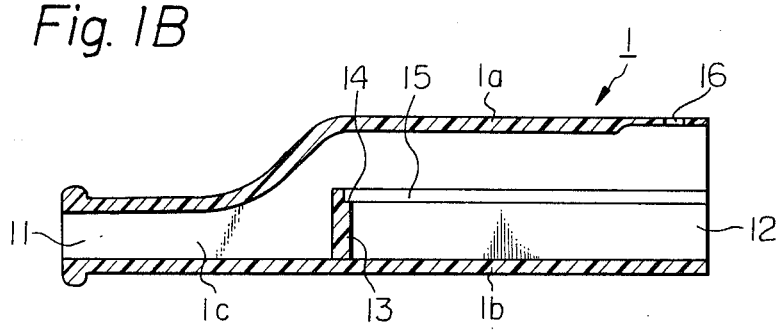
FIG. 1B is a section taken along a line IB—IB in FIG. 1A.
Figure 1C:
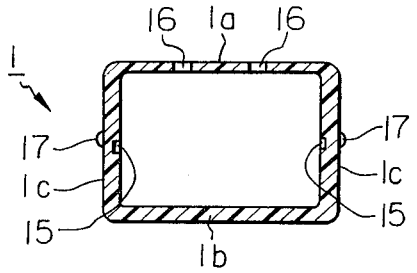
FIG. 1C is a section taken along a line IC—IC in FIG. 1A.
Figure 2A:
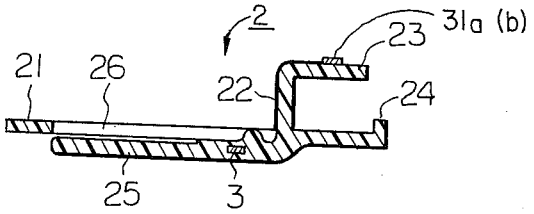
FIG. 2A is a side sectional view of one embodiment of the reed assembly of the mouth-piece in accordance with the present invention.
Figure 2B:
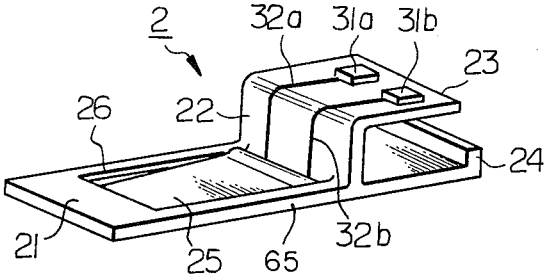
FIG. 2B is a perspective of the reed assembly shown in FIG. 2A.

As hereinbefore described, the mouth-piece in accordance with the present invention includes, as major elements, a cavitous main body 1 shown in FIGS. 1A and 1C and a reed assembly 2 accommodated in position within the main body 1 and shown in FIGS. 2A and 2B.

The main body 1 has a four sided elongated construction which is open on both longitudinal ends. One end 11 is normally referred to as the blow-in end and forms an inlet for the air while the other end is normally referred to as the blow-out end and forms an outlet for the air. The blow-in end 11 is smaller in transverse cross section than the blow-out end 12 so as to be easily and smoothly received in the mouth of a player. About the middle of its length, the main body 1 is internally provided with a transverse wall 13 which extends from the bottom wall **1*b* and is provided, near its top free end, with a step 14 for supporting the blow-in side end of the valve assembly 2 as hereinafter described in more detail. A horizontal groove 15 is formed in the inner surface of each side wall 1*c* and extends from the position of the transverse wall 13 to the blow-out end 12. These grooves 15 also serve to support the reed assembly 2. A pair of through holes 16 are formed in the top wall 1*a* at a position near the blow-out end 12. A small projection 17 is formed on the outer surface of each side wall 1*c*** to aid in the coupling of the mouth-piece to a connecting plug described below.

Preferably, the main body 1 is formed of a synthetic resin material.

One embodiment of the reed assembly 2 is shown in FIGS. 2A and 2B. The reed assembly 2 comprises a valve body 65 having a window like opening 26 formed therein and a valve flap 25 depending therefrom. Valve body 65 includes a lower flat section 21, an upright section 22 standing from the lower flat section 21, an upper flat section 23 extending from the top end of the upright section 22 towards the blow-out side, an upright projection 24 is formed at the blow-out side end of the lower flat section 21. The rectangular like opening 26 is formed through the lower flat section 21 and the valve flap 25 extends from the junction of the sections 21 and 22 towards the blow-in side. The free end of the valve flap 25 is located slightly beyond and below the blow-in side end of the opening 26. This cantilever-type valve flap 25 acts as a kind of reed and generates musical tones by its vibration.

A pressure responsive element 3 is embedded within the valve flap 25 at a position near the starting position of the valve flap 25. Known piezo-electric ceramic elements can be used for the pressure responsive element 25, which generates voltage signals in accordance with the magnitude of the applied mechanical pressure. Nickel alloy wire can be used for the pressure responsive element 25, which varies its resistance in accordance with the magnitude of applied mechanical pressure or strain. In any case, the pressure responsive element 25 generates electric signals in accordance with the magnitude of pressures applied thereto.

A pair of electric terminals 31*a* and 31*b* are arranged on the top surface of the upper flat section 23 and are connected to the respective electrodes of the pressure responsive element 25 via connections 32*a* and 32*b*. Preferably, the connections 32*a* and 32*b* are printed on the valve assembly 2 and proper water-proof treatment is applied thereto.

The entire valve assembly 2 is preferably made of an elastic material such as synthetic resin. However, at least the valve flap 25 should be made of such an elastic material.

Figure 3A:
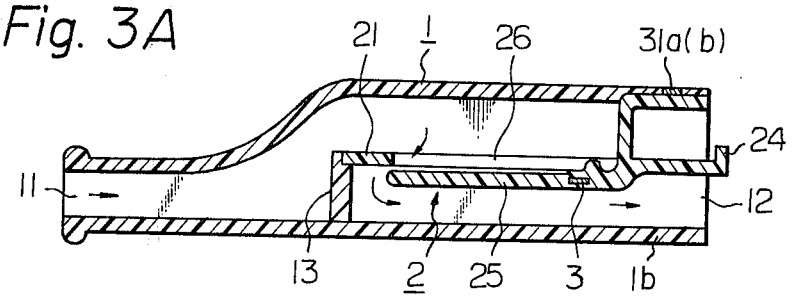
FIG. 3A is a side sectional view of one embodiment of the mouth-piece in accordance with the present invention in which the main body shown in FIGS. 1A to 1C is used in combination with the reed assembly shown in FIGS. 2A and 2B.
Figure 3B:
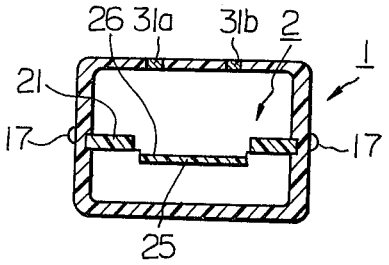
FIG. 3B is a transverse sectional view of the mouth-piece shown in FIG. 3A.

The assembled disposition of the main body 1 with the reed assembly 2 is shown in FIGS. 3A and 3B. The blow-in side end of the lower flat section 21 of the reed assembly 2 is placed on the step 14 of the transverse wall 13 of the main body 1, the side edges of the lower flat section 21 are snugly received within the horizontal grooves 15, the terminals 31*a* and 31*b* of the pressure responsive element 25 are located within the through holes 16 of the main body 1, and the projection 24 projects slightly from the blow-out end 12 of the main body 1.

As the mouth-piece is blown by a player, the air flows through the mouth-piece as shown with arrows in the illustration. When passing through the opening 26, the air flexes the valve flap 25 towards the bottom wall 1*b* of the main body 1. Apparently, the extent that the valve flap 25 deflects increases as the magnitude of the pneumatic pressure acting thereon increases, although there is a certain limit to the deflection. This limit in the deflection is dependent upon the elasticity of the material making up the valve flap 25.

The deflection of the valve flap 25 produces a corresponding mechanical strain thereof, which causes a change in stress, i.e. pressure, acting on the pressure responsive element 3 embedded therein. The pressure responsive element 3 thereupon generates an electric signal (such as a voltage signal) in accordance with the magnitude of the mechanical pressure acting thereon, i.e. the extent of the deflection of the valve flap 25. consequently, the pressure responsive element 25 generates different electric signals in accordance with the magnitude of the pneumatic pressure acting on the valve flap 25, i.e. the strength with which the player blow into the blow-in end 11 of the mouth-piece.

In practical use, the mouth-piece of the present invention is electrically connected to an input terminal of a signal processing circuit in an electronic musical instrument such as an electronic keyboard wind instrument.

Figure 4:
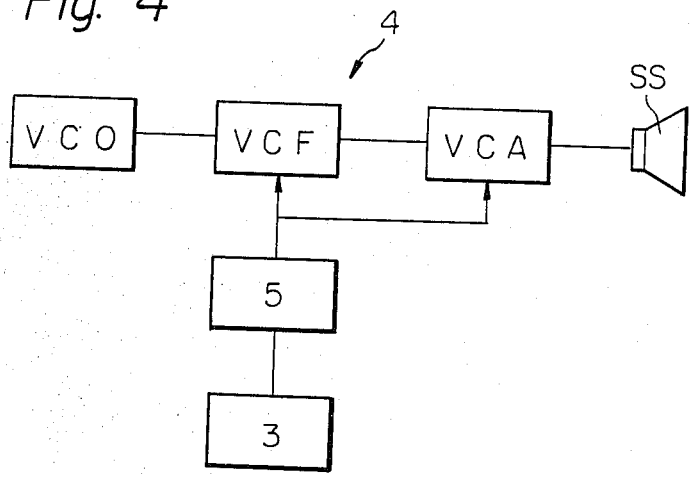
FIG. 4 is a block diagram of one example of the signal processing circuit to which the mouth-piece in accordance with the present invention is advantageously connected.

As shown in FIG. 4, one example of such a signal processing circuit 4 includes a voltage-control type oscillator VCO for control of tonal pitch, a voltage-control type filter VCF for control of tone colour, a voltage-control type variable gain amplifier VCA for control of tone volume and a sound system SS such as a speaker. The pressure responsive element 3 is electrically connected, via a suitable pressure-electric conversion circuit 5, to the filter VCF and the amplifier VCA.

Figure 5:
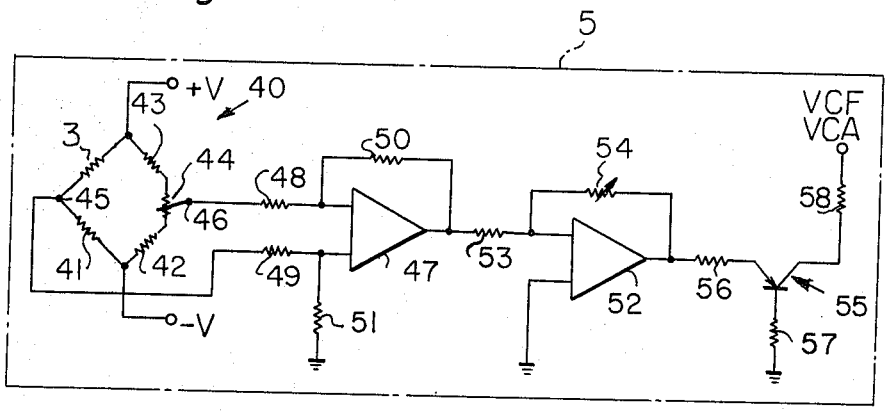
FIG. 5 is a detailed circuit diagram of the pressure electric conversion circuit of FIG. 4.

One example of the pressure-electric conversion circuit 5 is shown in FIG. 5.

In this embodiment, the pressure responsive element 3 is a pressure-responsive resistor whose resistance changes as a function of the deflection thereof. This resistor forms part of a bridge circuit 40 which also includes resistors 41–44. Opposite nodes 46, 47 of bridge circuit 40 are applied to respective input terminals of an operational amplifier 47. via respective resistors 48, 49. Resistor 48 is also coupled to a feedback resistor 50 while resistor 49 is coupled to ground via resistor 51. As a result, operational amplifier 47 compares the relative voltages at nodes 45 and 46 and generates an output signal whose magnitude and polarity are determined by the resistance of pressure-responsive element 3. Resistor 44 is a variable resistor which is used for zero point calibration to ensure that the output of amplifier 47 is at the zero point level whenever valve flap 25 is at rest.

The output of operational amplifier 47 is applied to a second operational amplifier 52 via resistor 53. A variable feedback resistor 54 adjusts the gain of amplifier 52 to ensure that the output signal applied to transistor 55 is at the desired level. The emitter of transistor 55 is coupled to the output of amplifier 54 via a resistor 56. The base of transistor 55 is coupled to ground via resistor 57 while its collector is coupled to both the voltage-control type filter VCF and the voltage-control type variable gain amplifier VCA via resistor 58.

In a modified use of the mouth-piece in accordance with the present invention, the pressure responsive element 3 of the mouth-piece may be electrically connected to the amplifier VCA via a suitable envelope shaping circuit.

As described above, there is a limit to the deflection the valve flap 25 depending on the elasticity of the material making up the valve flap. In other words, extent of deflection of the valve flap has a saturation point despite increases in the blow pressure at the blow-in end of the mouth-piece. Likewise, the tone volume to be generated by the musical instrument also has a corresponding saturation point despite increases in the blow pressure. Consequently, the relationship between the tone volume and the blow pressure closely resembles that of natural wind instruments, thereby making it possible to generate wide variety of colourful musical tones in a manner similar to those generated by natural wind instruments.

Figure 6:
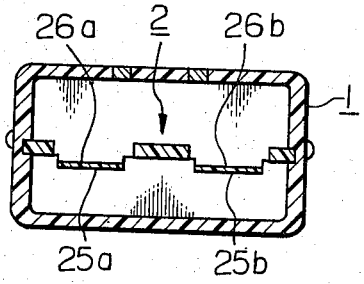
FIG. 6 is a transverse cross sectional view of another embodiment of the mouth-piece in accordance with the present invention.
Figure 8:
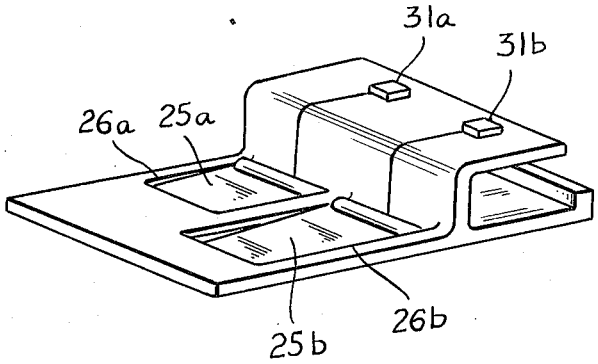
FIG. 8 is a perspective view of a second embodiment of the reed assembly in accordance with the present invention.
Figure 9:
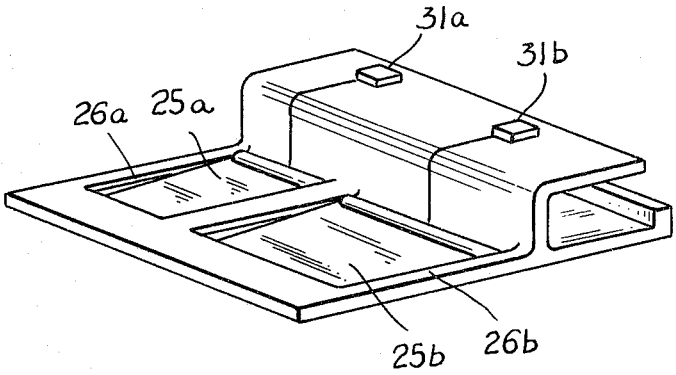
FIG. 9 is a perspective view of a third embodiment of the reed assembly of the present invention.

A modified embodiment of the mouth-piece in accordance with the present invention is shown in FIG. 6, in which the reed assembly 2 is provided with a pair of parallel window-like openings 26*a* and 26*b* accompanied by valve flaps 25*a* and 25*b*. In this case, presence of two separate air passages enables generation of a wider variety of musical tones than those generated by the valve assembly with a single air passage. When required the, dimension (see FIG. 8) and/or shape (see FIG. 9) of the two openings and valve flaps may be designed different from each other in order to obtain a further wider variety of musical tones. Further, it is also possible to provide more than two air passages in the valve assembly. In each case, a separate pressure responsive element 3 is coupled to its respective valve flap, by way of example, in the manner described above with reference to FIG. 3A.

Figure 11:
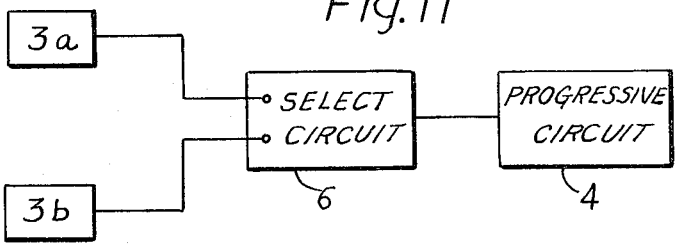
FIG. 11 is a block diagram illustrating the manner in which a plurality of pressure-responsive elements may be coupled to a signal processing circuit such as that illustrated in FIG. 4.

In a further modified embodiment of the present invention (see FIG. 11), the valve assembly may include two or more pressure responsive elements 3*a*, 3*b*. In this case, each pressure responsive element may be selectively connected to the signal processing circuit 4 via a signal selection circuit 6. Alternatively, different pressure responsive elements may be connected to different operational elements in the signal processing circuit 4. Further, the pressure responsive element or elements may be arranged on the outer surface of the valve flap.

Figure 10:
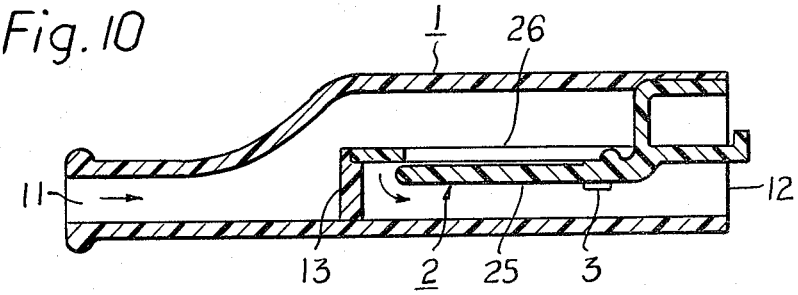
FIG. 10 is a side sectional view of an alternative embodiment of the mouth-piece in accordance with the present invention.

See FIG. 10. Additionally, when two or more valve flaps are employed, the flexibility of a first valve flap may be different from the flexibility of a valve second flap.

Figure 7:
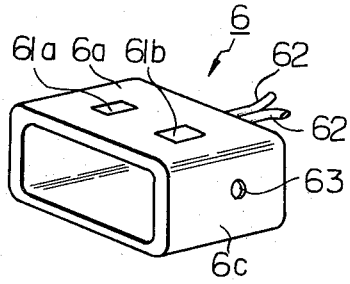
FIG. 7 is a perspective view of a connecting plug used for connecting the mouth-piece in accordance with the present invention to a signal processing circuit given in electronic musical instruments.

One embodiment of means for coupling the mouthpiece to general electronic keyboard musical instruments or keyboard synthesizers is shown in FIG. 7. In this case, the coupling means take the form of a connecting plug 6. The connecting plug 6 has a cavitious construction closed at one longitudinal end. The connecting plug 6 is provided with a pair of contacts 61*a* and 61*b* arranged through the top wall 6*a* thereof, a pair of lead wires 62 electrically connected to the respective contacts 61*a* and 61*b*, and a pair of through holes 63 formed in the side walls 6*c* thereof.

In use, the blow-out end portion of the mouth-piece is inserted into the connecting plug 6 until its side projections 17 are registered at the side holes 63. In this coupled disposition, the top electric terminals 31*a* and 31*b* are brought into contact with the top contacts 61*a* and 61*b* of the connecting plug 6, respectively.

As is clear from the foregoing description, employment of the mouth-piece in accordance with the present invention assures, despite its simple construction, successful generation of a wide variety of intricately controlled colourful musical tones by electronic musical instruments in much the same manner as those by natural wind instruments.

I claim:

1. An improved mouth-piece for an electronic instrument, comprising:

(a) a main body defining an air passage having a blow in opening and a blow out opening; said air passage being arranged such that air forced into said blow in opening passes through said air passage and out said blow out opening;

(b) a reed assembly located in said air passage of said main body and including a valve body having an opening formed therein and a valve flap lying adjacent said opening and depending from an edge of said opening, said reed assembly being so located within said air passage that air flowing through said passage passes through said opening and vibrates said valve flap so as to cause the generation of a musical tone;

(c) a pressure responsive element attached to said valve flap at a position near said edge of said opening, said pressure responsive element adapted to generate electrical signals which vary as a function of the vibration of said valve flap; and (d) means for connecting said pressure responsive element to a signal processing circuit of said musical instrument.

2. An improved mouth-piece as claimed in claim 1, further including:

a second opening formed in said valve body, the dimensions of said second opening being different from the dimensions of said first opening;

a second valve flap lying adjacent said second opening and depending from an edge thereof, the dimensions of said first and second valve flaps being substantially similar to the dimensions of said first and second openings, respectively; and a second pressure-responsive element attached to said second valve flap at a position near said edge of said second opening, said second pressure-responsive element adapted to generate electrical signals which vary as a function of the vibration of said valve flap.

3. An improved mouth-piece as claimed in claim 1, further comprising:

a second opening formed in said valve body, the shape of said second opening being different from the shape of said first opening;

a second valve flap lying adjacent said second opening and depending from an edge thereof, the shape of said first and second valve flap being substantially similar to the shape of said first and second openings, respectively; and a second pressure-responsive element attached to said second valve flap at a position near the edge of said second opening, said second pressure-responsive element adapted to generate electrical signals which vary as a function of the vibration of said second valve flap.

4. An improved mouth-piece as claimed in claim 2 or 3, wherein the flexibility of said first valve flap is different from the flexibility of said second valve flap.

5. An improved mouth-piece as claimed in claim 2 or 3, wherein said connecting means also connects said second pressure responsive element to said signal processing circuit and wherein said connecting means includes means for selectively applying the electrical signal generated by one of said pressure responsive elements to said signal processing circuit.

6. An improved mouth-piece as claimed in claim 1, further including:

a second opening formed in said valve body;

a second valve flap lying adjacent said second opening and depending from an edge thereof, the flexibility of said first valve flap being different from the flexibility of said second valve flap; and a second pressure-presponsive element attached to said second valve flap at a position near said edge of said second opening, said second pressure-responsive element adapted to generate electric signals which vary the function of the vibration of said second valve flap.

7. An improved mouth-piece as claimed in claim 6, wherein said connecting means also connects said second pressure-responsive element to said signal processing circuit and wherein said connecting means includes means for selectively applying the electric signals generated by one of said pressure-responsive elements to said signal processing circuit.

8. An improved mouth-piece as claimed in claim 1, wherein said pressure-responsive element is embedded within said valve flap.

9. An improved mouth-piece as claimed in claim 1, wherein said pressure-responsive element is connected to an outer surface of said valve flap.

10. An improved mouth-piece as claimed in claim 1, wherein said connecting means includes electric connections printed on the surface of said valve body.

11. An improved mouth-piece as claimed in claim 1, wherein said opening and said valve flap are both planar and wherein said opening lies in a plane which is spaced from and generally parallel to a plane in which said valve flap lies when said valve flap is at rest.

12. An improved mouth-piece as claimed in claim 11, wherein said opening and said valve flap are both rectangular in shape.

* * * * *